United States Patent [19]

Tamura

[11] 4,449,809

[45] May 22, 1984

[54] DRIVE UNIT MOUNTING MECHANISM FOR REPRODUCING APPARATUS

[75] Inventor: Takashi Tamura, Higashimine, Japan

[73] Assignee: Konishiroku Photo Industry Co., Ltd., Tokyo, Japan

[21] Appl. No.: 451,820

[22] Filed: Dec. 21, 1982

[30] Foreign Application Priority Data

Dec. 28, 1981 [JP] Japan ..... 56-197905

[51] Int. Cl.[3] ..... G03G 15/00

[52] U.S. Cl. ..... 355/3 DR; 355/3 R; 29/123; 403/24

[58] Field of Search ..... 355/3 DR, 3 R, 16, 14 R; 29/123, 110, 117; 242/67.3 R, 72 R; 101/375, 378; 403/24, 41

[56] References Cited

U.S. PATENT DOCUMENTS 4,040,157 8/1977 Shanly ..... 355/3 DR X
4,105,345 8/1978 Van Wagner ..... 403/24
4,134,669 1/1979 Reitner ..... 355/3 DR
4,239,375 12/1980 Eisbein et al. ..... 355/16
4,344,700 8/1982 Kasama et al. ..... 355/3 DR X
4,345,834 8/1982 Kimura et al. ..... 355/3 R

*Primary Examiner*—A. C. Prescott
*Attorney, Agent, or Firm*—James E. Nilles

[57] ABSTRACT

A drive unit mounting mechanism in a reproducing apparatus having a machine frame, a drive unit provided at one side of the machine frame and a driven member provided at the other side of the machine frame, in which when a drive shaft projected from the drive unit through the machine frame is adapted to drive the driven member an insertion pin projected from a carrier for carrying the driven member is inserted into holes formed in the machine frame and in the drive unit so that the drive unit is correctly aligned with the machine frame.

3 Claims, 1 Drawing Figure

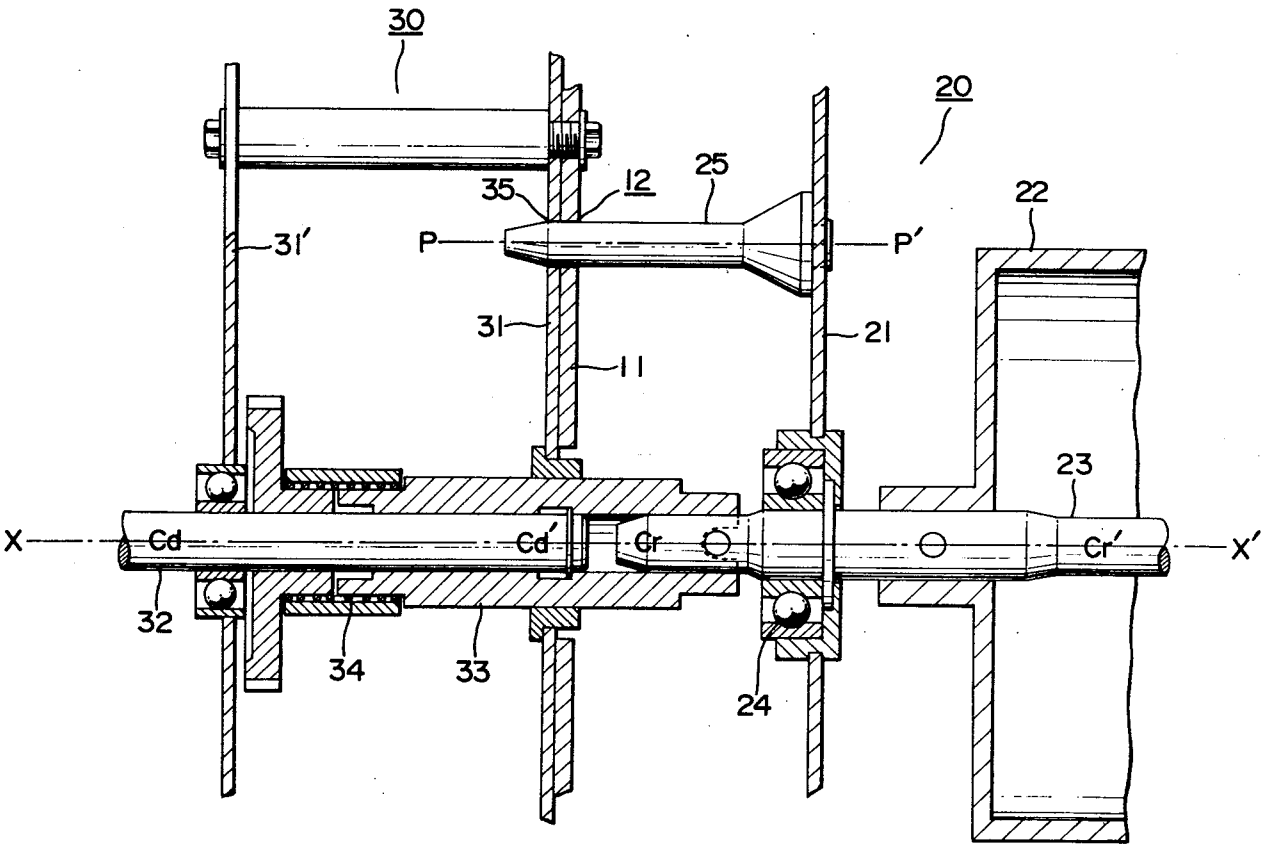
X'
Cr'
23
22
20
P'
21
24
25
12
11
Cr
35
31
Cd'
33
P
30
34
31'
Cd
32
X

DRIVE UNIT MOUNTING MECHANISM FOR REPRODUCING APPARATUS

BACKGROUND OF THE INVENTION

1. Field of the Invention

The present invention broadly relates to a reproducing apparatus having a rotary photosensitive drum or a developing drum supported by drum carriers and, more particularly, to a drive mechanism including a driving unit having a drive shaft adapted for driving each drum. Still more particularly, the invention is concerned with a mechanism for mounting the driving unit on the drum carrier.

2. Description of the Prior Art

In general, the axial alignment or misalignment between the driving rotary shaft for transmitting the driving power from a driving source such as motor and a rotary shaft which is driven by the driving rotary shaft largely affects the safe operation of the device which is operated by the rotary shaft, as well as the frequency of occurrence of troubles and, moreover, the durability of the device.

The connection between the driving rotary shaft and driven rotary shaft is usually achieved by means of a coupling. The axial alignment, which is generally referred to as "centering", is achieved by fitting the driven rotary shaft to the coupling fixed to the driving rotary shaft. Although the axial alignment is ensured to some extent by the fitting, the connection by the coupling does not always ensure the parallelism of axes of two shafts. Hitherto, the axial alignment and parallelism of two shafts have been attained by the centering work which is conducted by determining the position and inclination of the shaft within a three-dimensional space around the point of connection without any definite information concerning the amount and direction of error. Thus, the centering is quite inefficient work necessitating patience and time, although it is indispensable.

It is a common measure to employ a centering jig to avoid such inconveniences. The centering jig which is usable commonly for various centering works much have a play or tolerance in its size. An addition, the centering jig becomes unsatisfactory due to wear and deflection incurred during long common use. Therefore, hitherto, it has been necessary to prepare and carry independent centering jigs for various centering works.

SUMMARY OF THE INVENTION

Accordingly, an object of the invention is to provide a prompt, easy and sure method for conducting the centering which is quite an important and laborious but essential work in the assembling or reassembling of a reproducing apparatus after disassembling for repair.

To this end, according to the invention, there is provided, in a reproducing apparatus having a machine frame, a drive unit provided at one side of the machine frame and driven member provided at the other side of the machine frame, a mechanism for mounting the drive unit comprising: a drive shaft projected from the drive unit through the machine frame and adapted to drive the driven member; an insertion pin projected from a carrier for carrying the driven member and insertion holes formed in the machine frame and in the drive unit so as to receive the insertion pin when the carrier is mounted on the machine frame to connect the drive shaft and the driven member with the drive unit correctly aligned with the machine frame.

Other objects and features of the invention will become clear from the following description of the preferred embodiment taken in conjunction with the accompanying drawing.

BRIEF DESCRIPTION OF THE DRAWING

The attached sole FIGURE is an illustration of an embodiment of the invention.

DESCRIPTION OF THE PREFERRED EMBODIMENT

Hereinunder, a preferred embodiment of the invention will be described with specific reference to the accompanying drawing.

Referring first to FIGURE, a reference numeral 11 designates a panel of a reproducing machine, XX' designates a drive shaft axis on the panel 11, and 12 denotes a reference hole having a center which is positioned at a predetermined distance from the drive shaft axis XX'. A reference numeral 20 designates a drum carrier carrying a photosensitive drum 22 as an image supporting drum or a developing drum (not shown), while 21 denotes a drum carrier panel. The photosensitive drum 22 has a shaft 23 rotatably mounted on the carrier panel 21 through a pair of bearings 24. The rotary shaft 23 has an axis CrCr' of rotation. An insertion pin 25 is firmly fixed in the carrier panel 21. The positional relationship between insertion pin 25 on the carrier panel 21 and the axis CrCr' of rotation is identical to that between the drive shaft axis XX' and the reference hole 12 on the panel 11. In addition, the insertion pin 25 has a diameter matching for that of the reference hole 12. Axis of the insertion pin 25 is represented by PP'. A reference numeral 30 denotes a drive unit having a driving mechanism such as a driving rotary shaft for driving the photosensitive drum 22 and so forth. Reference numerals 31 and 31' designate base plates on which the driving mechanism is mounted. The base plate 31 opposes to and contacts with the panel 11. A reference numeral 32 designates a drive shaft for rotatingly driving the photosensitive drum 22 and having an axis CdCd'. The drive shaft 32 is provided with a coupling 33 through which the drive shaft 32 is connected to the rotary shaft 23 thereby to transmit the rotation to the latter. In the described embodiment, a spring clutch 34 is provided between the drive shaft 32 and the coupling 33. A reference numeral 35 designates a fitting hole provided in the base plate 31. The positional relationship between the fitting hole 35 and the axis CdCd' of the drive shaft is identical to that between the drive shaft axis XX' and the reference hole 12 on the panel 11.

For fixing the drive unit 30 to the drum carrier 20 in alignment with each other, the drum carrier 20 is mounted on the panel 11 with the insertion pin 25 inserted into the reference hole 12 such that the head of the pin 25 is exposed from the surface of the panel 11. Then, the centering between the drive shaft axis CdCd' and the rotary shaft axis CrCr' is made by fitting hole 35 of the base plate 31 to the exposed head of the insertion pin 25, while fitting the rotary shaft 23 to the coupling 33. This centering work can be made simply by making the drive shaft axis CdCd' contained by the plane determined by the insertion pin axis PP' and the rotary shaft axis CrCr'. It is, therefore, possible to make the centering easily, promptly and surely. After the completion of the centering, the drive unit 30 is firmly secured to the panel 11 so that the drive unit and the drum carrier are fixed to each other in alignment with each other.

The number of the combinations of the reference hole, insertion pin and the fitting hole can be determined suitably taking into account the cost and the efficiency of the work. It has been confirmed that the number of steps of the process for assembling a reproducing apparatus can be reduced remarkably.

What is claimed is:

1. In a reproducing apparatus having a machine frame, a drive unit provided at one side of said machine frame and a driven member provided at the other side of said machine frame, a drive unit mounting mechanism comprising: a drive shaft projected from said drive unit through said machine frame and adapted to drive said driven member; an insertion pin projected from a carrier for carrying said driven member and insertion holes formed in said machine frame and in said drive unit so as to receive said insertion pin when said carrier is mounted on said machine frame to connect said drive shaft and said driven member with said drive unit correctly aligned with said machine frame.

2. A drive unit mounting mechanism as claimed in claim 1, wherein the drive unit comprises the drive shaft and base plates supporting the drive shaft, one of the base plates opposing to and contacting with the machine frame and having the insertion hole.

3. A drive unit mounting mechanism as claimed in claim 1, wherein said driven member is an image supporting drum supported by said drive shaft.

* * * * *